US006377605B1

(12) United States Patent
McCaffrey

(10) Patent No.: US 6,377,605 B1
(45) Date of Patent: Apr. 23, 2002

(54) ELECTRODE SEAL FOR ARC FURNACE

(75) Inventor: Felim P. McCaffrey, Toronto (CA)

(73) Assignee: Hatch Associates Ltd., Mississauga (CA)

( * ) Notice: Subject to any disclaimer, the term of this patent is extended or adjusted under 35 U.S.C. 154(b) by 0 days.

(21) Appl. No.: 09/796,545

(22) Filed: Mar. 2, 2001

(51) Int. Cl.[7] ..... H05B 7/10; H05B 7/12
(52) U.S. Cl. ..... 373/95; 373/94; 373/100
(58) Field of Search ..... 373/52, 94, 95, 373/96, 98, 99, 100, 101

(56) References Cited

U.S. PATENT DOCUMENTS

| | | | | |
|---|---|---|---|---|
| 1,549,431 A | | 8/1925 | Beck | |
| 1,690,795 A | | 11/1928 | Sagramoso | |
| 1,732,431 A | | 10/1929 | Bruggmann | |
| 2,979,550 A | | 4/1961 | Sherman, Sr. | |
| 3,379,816 A | | 4/1968 | Hozven | |
| 3,683,095 A | | 8/1972 | Salmin et al. | |
| 3,697,660 A | | 10/1972 | Frolov et al. | |
| 3,709,506 A | | 1/1973 | Beerman | |
| 3,835,233 A | | 9/1974 | Prenn | |
| 4,027,095 A | | 5/1977 | Kishida et al. | |
| 4,295,001 A | | 10/1981 | Britton | |
| 4,306,726 A | | 12/1981 | Lefebvre | |
| 4,347,400 A | | 8/1982 | Lamarque | |
| 4,377,289 A | | 3/1983 | Lefebvre | |
| 4,394,765 A | | 7/1983 | Reimpell et al. | |
| 4,442,526 A | | 4/1984 | Rappinger et al. | |
| 4,457,002 A | | 6/1984 | Mathgen et al. | |
| 4,670,884 A | * | 6/1987 | Letizia et al. | 373/101 |
| 4,759,032 A | | 7/1988 | Willis | |
| 5,056,104 A | * | 10/1991 | Ambrosi | 373/100 |
| 5,200,974 A | | 4/1993 | Kark et al. | |
| 5,406,580 A | | 4/1995 | McCaffrey | |

FOREIGN PATENT DOCUMENTS

| | | |
|---|---|---|
| DE | 331249 | 1/1921 |
| DE | 1440467 | 3/1968 |
| FR | 1418153 | 10/1965 |
| WO | WO95/17801 | 6/1995 |

OTHER PUBLICATIONS

Mark Cywinski, "Preventing EAF fume and dust escape", Steel Times International, Nov. 1992, p. 24.

* cited by examiner

*Primary Examiner*—Tu Ba Hoang
(74) *Attorney, Agent, or Firm*—Ridout & Maybee LLP

(57) ABSTRACT

An electrode seal for an electric arc furnace comprises an annular support ring having an internal diameter substantially greater than the diameter of the electrode, and which is secured to the furnace roof by a plurality of mounting feet. The annular support ring has an upper annular sealing surface on which is supported an annular sealing ring having an internal diameter which is approximately the same as the diameter of the electrode to form a substantial seal therewith. The sealing ring has a lower annular sealing surface which engages the upper sealing surface of the support ring, while allowing limited sliding movement of the sealing ring along its lower annular sealing surface.

16 Claims, 12 Drawing Sheets

10
32
34
38
42
44
46
48
50
54
56
58
68
76
86
92
20
126
132
134
152
156
IV
VI

ELECTRODE SEAL FOR ARC FURNACE

FIELD OF THE INVENTION

This invention relates to an electrode seal for an electric furnace having one or more large diameter electrodes extending through an opening in the furnace roof.

BACKGROUND OF THE INVENTION

Electric arc furnaces used for melting metals usually comprise a crucible and one or more generally vertical carbon electrodes supported so as to depend into the crucible. In order to contain fumes, maintain a desired atmosphere within the furnace and control heat loss and noise, it is common practice to provide such furnaces with a lid or roof having apertures through which the electrodes depend.

Particularly during the initial stages of melting a charge, current surges through the electrode apply very substantial electromagnetic forces, which can cause significant lateral deflection of the electrodes. Therefore, it is necessary to provide a clearance between the electrode and the aperture in the furnace roof in order to prevent the furnace roof from being damaged by movement of the electrode. However, as such arc furnaces operate at close to atmospheric pressure, and can go into positive pressure, harmful gases such as oxides of nitrogen and carbon-monoxide, are released into the atmosphere through the gap, therefore making it desirable to provide some sort of seal arrangement between the electrode and the furnace roof.

The seal must prevent substantial escape of fumes through the gap while permitting vertical and lateral movement of the electrode. The provision of adequate sealing is especially difficult in electric arc furnaces where it is necessary to completely withdraw the electrode from the furnace. Examples of this type of furnace include arc furnaces used to melt scrap steel. Such furnaces have a single electrode which is completely withdrawn from the furnace several times per hour to allow fresh scrap steel to be charged through the hole in the furnace roof. After the scrap material is charged, the electrode is again inserted through the aperture in the furnace roof and bores through the solid scrap material until it reaches a desired depth. During this boring operation, significant noise is generated by arcing between the electrode and the solid scrap material. The noise typically abates as the material is melted.

Although the prior art contains numerous examples of electrode seals to solve this very problem, none has proved generally acceptable to operators of arc furnaces used for the melting of steel, and particularly where complete withdrawal of the electrode is required. Therefore, many electric arc furnaces continue to be operated without any seal at all.

SUMMARY OF THE INVENTION

The present invention overcomes at least some of the problems of the prior art by providing an electrode seal for electric arc furnaces which is effective to substantially reduce fumes and noise associated with melting of metals in arc furnaces, is of relatively simple and economical construction, can be made sufficiently light to be safely supported on the refractory portion of the furnace roof surrounding the electrodes, is compatible with repeated complete withdrawal of the electrodes from the furnace, and can help extend the life of the electrode and the refractory roof.

The electrode seal according to the invention comprises an annular support ring having an internal diameter substantially greater than the diameter of the electrode, and which is secured to the furnace roof by a plurality of mounting feet. The annular support ring has an upper annular sealing surface on which is received an annular sealing ring having an internal diameter which is approximately the same as the diameter of the electrode to form a substantial seal therewith. The sealing ring has a lower annular sealing surface which engages the upper sealing surface of the support ring, while allowing limited sliding movement of the sealing ring along its lower annular sealing surface.

Thus, the present invention provides an electrode seal of simple construction in which escape of gas through the aperture in the furnace roof is greatly reduced by a tight-fitting sealing ring, which is laterally movable to account for lateral movement and misalignment of the electrodes.

Testing of the electrode seal of the present invention has shown that the electrode seal effectively inhibits escape of gases from the furnace, and also significantly reduces the noise level in the vicinity of the furnace.

BRIEF DESCRIPTION OF THE DRAWINGS

The invention will now be described, by way of example only, with reference to the accompanying drawings, in which.

DETAILED DESCRIPTION OF PREFERRED EMBODIMENTS

A preferred electrode seal 10 according to the invention will now be described below with reference to the drawings. Electrode seal 10 is described in the context of a DC arc furnace having a single graphite electrode 12 (shown in FIG. 4 only), typically having a diameter of 28 inches, and a roof. The roof is preferably of conventional construction, having an outer portion of water-cooled steel (not shown) and an inner refractory portion 14 surrounding the electrode 12. The refractory portion 14 of the roof, sometimes referred to as the "refractory button", is preferably provided with a steel frame (not shown) by which it is supported in an aperture in the water-cooled roof. Although the invention is being described in connection with a DC arc furnace, it will be appreciated by those skilled in the art that the principles of the invention may also be applied to AC arc furnaces.

Figure 4:
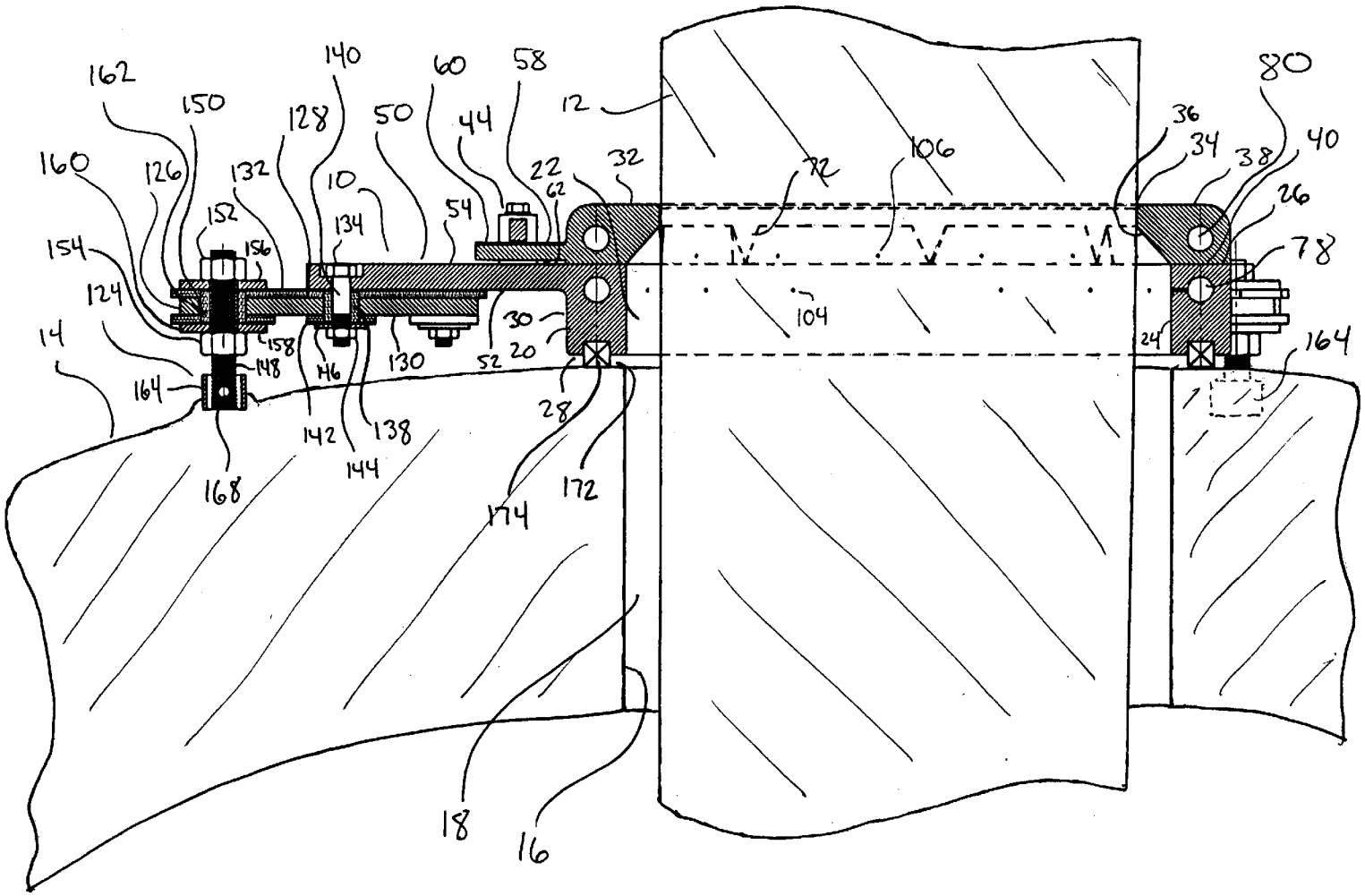
FIG. 4 is a cross-sectional view along line IV—IV of FIG. 2.

The refractory portion 14 of the furnace roof has an aperture 16 (also shown in FIG. 4). The aperture 16 has a diameter of about 32 inches, leaving an annular gap 18 of about 2 inches between electrode 12 and the aperture 16 in the refractory portion 14.

The electrode seal 10 comprises an annular support ring 20 defining a first aperture 22 having an internal diameter greater than the external diameter of electrode 12. Preferably, the internal diameter of the annular support ring 20 is substantially the same as the diameter of the aperture 16 in the refractory portion 14 of the roof. In the preferred embodiment shown in the drawings, the internal diameter of support ring 20 is about 32 inches.

Support ring 20 further comprises an inner surface 24 which faces radially inwardly and is parallel to the axis of electrode 12, an upper annular sealing surface 26 perpendicular to inner surface 24, a lower annular surface 28 and an outer surface 30 facing radially outwardly.

The height of inner surface 24, and the support ring itself, is about 5½ inches and the thickness of the ring, measured perpendicular to the electrode axis is about 7 inches.

Extending radially outwardly from the outer surface 30 of support ring 20 are three flanges 50, each of which has a planar lower surface 52 perpendicular to the axis of electrode 12 and a planar upper surface 54 which is also perpendicular to the axis of electrode 12. The flanges are of sufficient strength to support the weight of the electrode seal 10 and to withstand lateral forces exerted on the seal 10 by electrode 12.

Electrode seal 10 further comprises an annular sealing ring 32 which is supported on the upper sealing surface 26 of the support ring 20. The sealing ring 32 defines a second aperture 34 having an internal diameter which is approximately the same as the diameter of the electrode 12 and which is less than the diameter of the first aperture 22. In the preferred electrode seal 10, the diameter of the second aperture is preferably about 28⅛ inches, resulting in an annular gap of about 1/16 inch between the sealing ring 32 and the outer surface of electrode 12 to allow for irregularities in the outer surface of electrode 12. Typically, such electrodes are manufactured to a tolerance of about ±1 mm (about 1/25 of an inch).

The annular sealing ring 32 further comprises an inner surface 36 which faces radially inwardly, an upper surface 38, a lower annular sealing surface 40, and an outer surface 42 facing radially outwardly.

Figure 5:
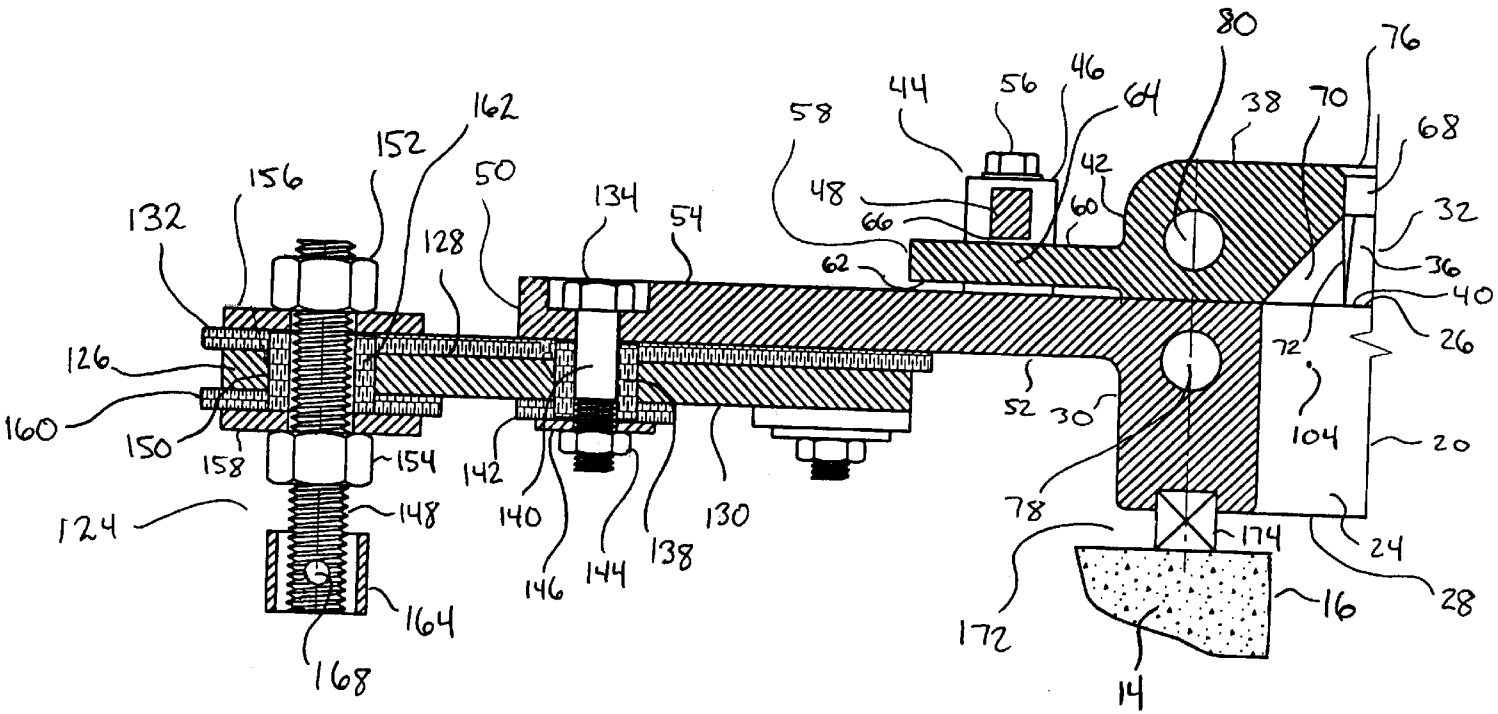
FIG. 5 is an enlargement of the left-hand portion of the cross-sectional view shown in FIG. 4.
Figure 6:
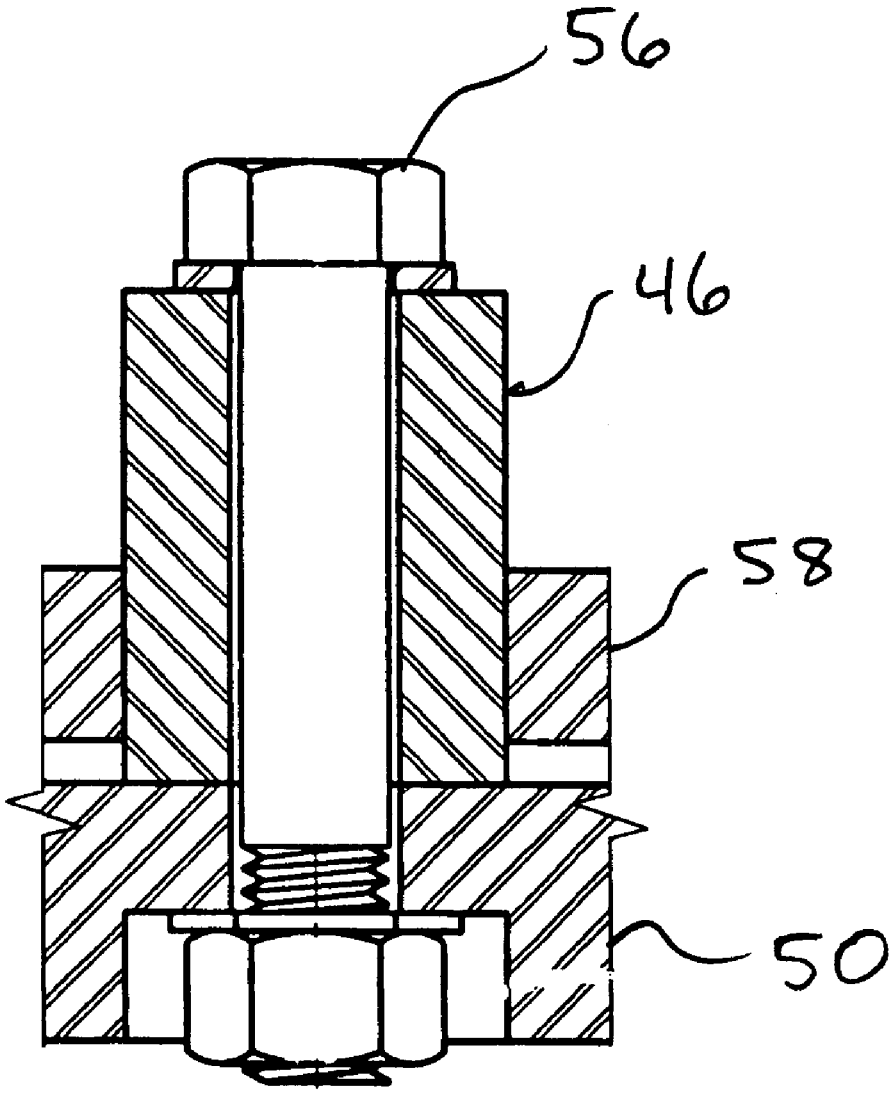
FIG. 6 is a partial cross-sectional view along line VI—VI of FIG. 2.

As shown in FIG. 5, the lower annular sealing surface 40 of sealing ring 32 comprises a flat surface which is perpendicular to the axis of electrode 12 and which engages the upper annular sealing surface 26 of the support ring 20 such that the second aperture 34 defined by the sealing ring 32 is in substantially complete registry with the first aperture 22 defined by the support ring 20.

Figure 8:
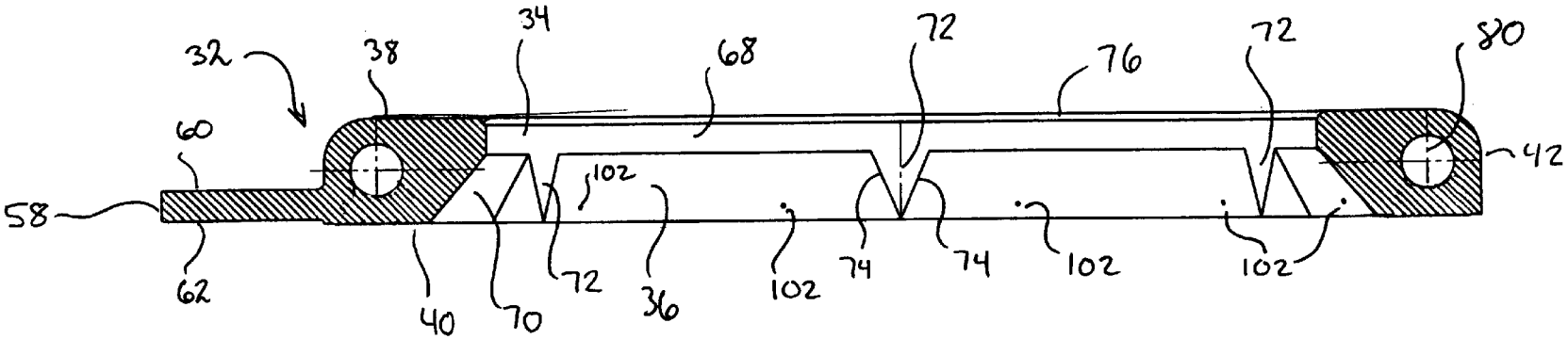
FIG. 8 is a cross-sectional view along line VIII—VIII of FIG. 7.

As shown in FIGS. 4 and 8, the inner surface 36 of sealing ring 32 comprises an axially-extending sealing portion 68 proximate the upper surface 38 of sealing ring 32, an outwardly-extending portion 70 generally tapering downwardly and radially outwardly from the axially-extending sealing portion 68 toward the lower annular sealing surface 40 of the sealing ring 32, and a plurality of axially-extending scraper elements 72 spaced from one another along the circumference of the outwardly-extending portion 70 and extending downwardly from the sealing portion 68, each scraper element having a pair of sides extending downwardly toward one another.

The sealing portion 68 defines the diameter of the second aperture 34 of electrode seal 10, having a diameter of 28⅛ inches in order to form an effective seal with the surface of electrode 12. The sealing portion 68 preferably has an axial height of about 1½ inches, with a small chamfer preferably being provided between the sealing portion 68 and the upper surface 38 of sealing ring 32 to assist in guiding the electrode 12 into the aperture 34. The chamfer may preferably be about ¼ inch×45 degrees.

The outwardly-extending portion 70 is preferably angled at about 35 to 40° relative to the lower annular sealing surface 40 of sealing ring 32, and has an axial height of about 2 inches. The outwardly-extending portion 70 gradually increases the inside diameter of the sealing ring 32 such that the diameter of sealing ring 32 proximate its lower surface 40 is approximately the same as that of the support ring 20 which, in the preferred embodiment, is about 32 inches.

Preferably, the scraper elements 72 are co-planar with the axially extending sealing portion 68 and are formed in the shape of triangular wedges, with the sides 74 of each scraper element 72 meeting at a point below the axially-extending sealing portion 68. Preferably, each scraper element 72 has an axial height of 1¾ inches and a maximum width at its upper end of 2 inches. Scraper elements 72 break off solid deposits of slag and steel sticking to the outer surface of electrode 12 as the electrode 12 is lifted out of the furnace.

Figure 1:
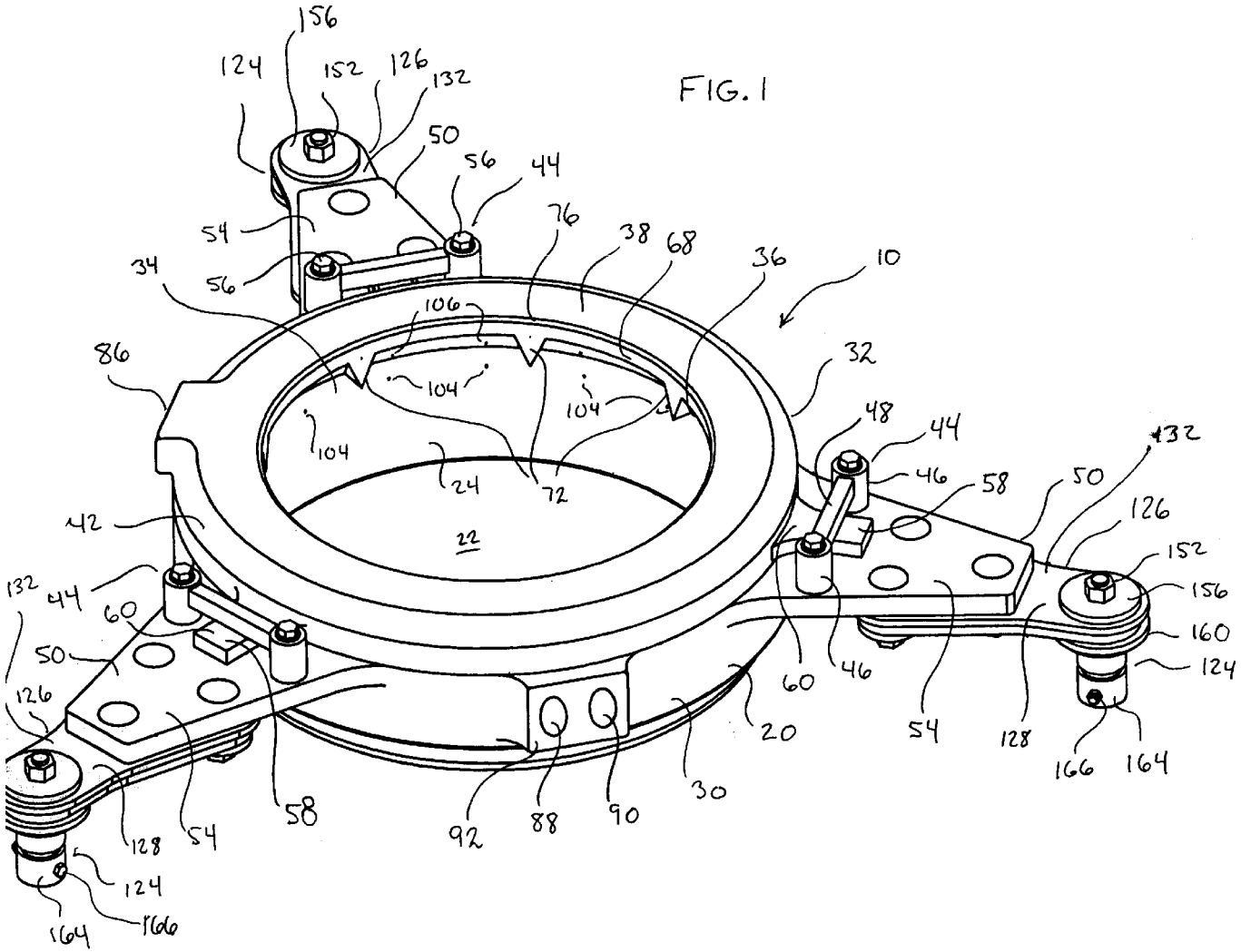
FIG. 1 is a perspective view from the top and the side of an electrode seal according to a first preferred embodiment of the invention, shown in isolation.
Figure 2:
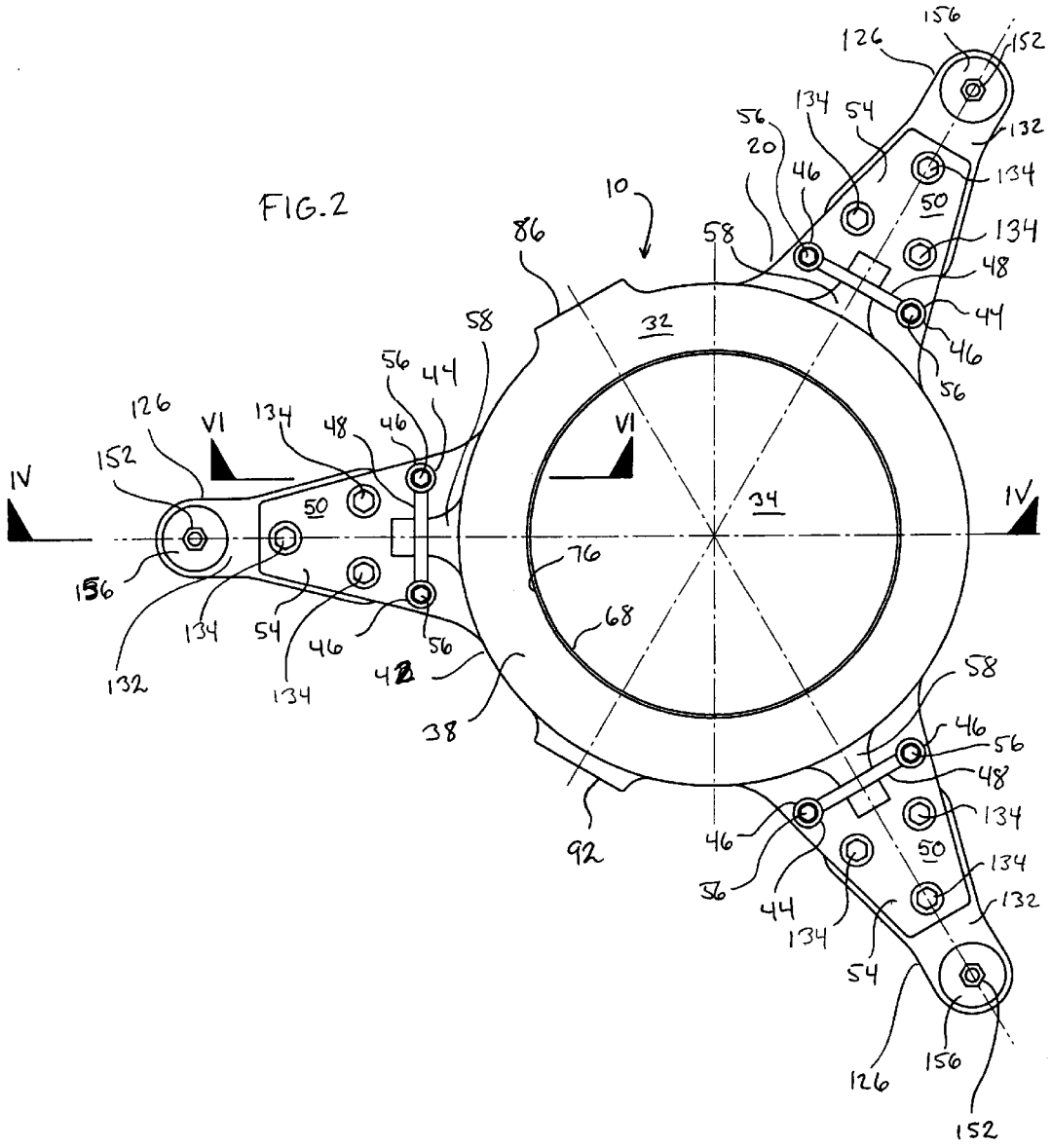
FIG. 2 is a top plan view of the electrode seal shown in FIG. 1.
Figure 3:
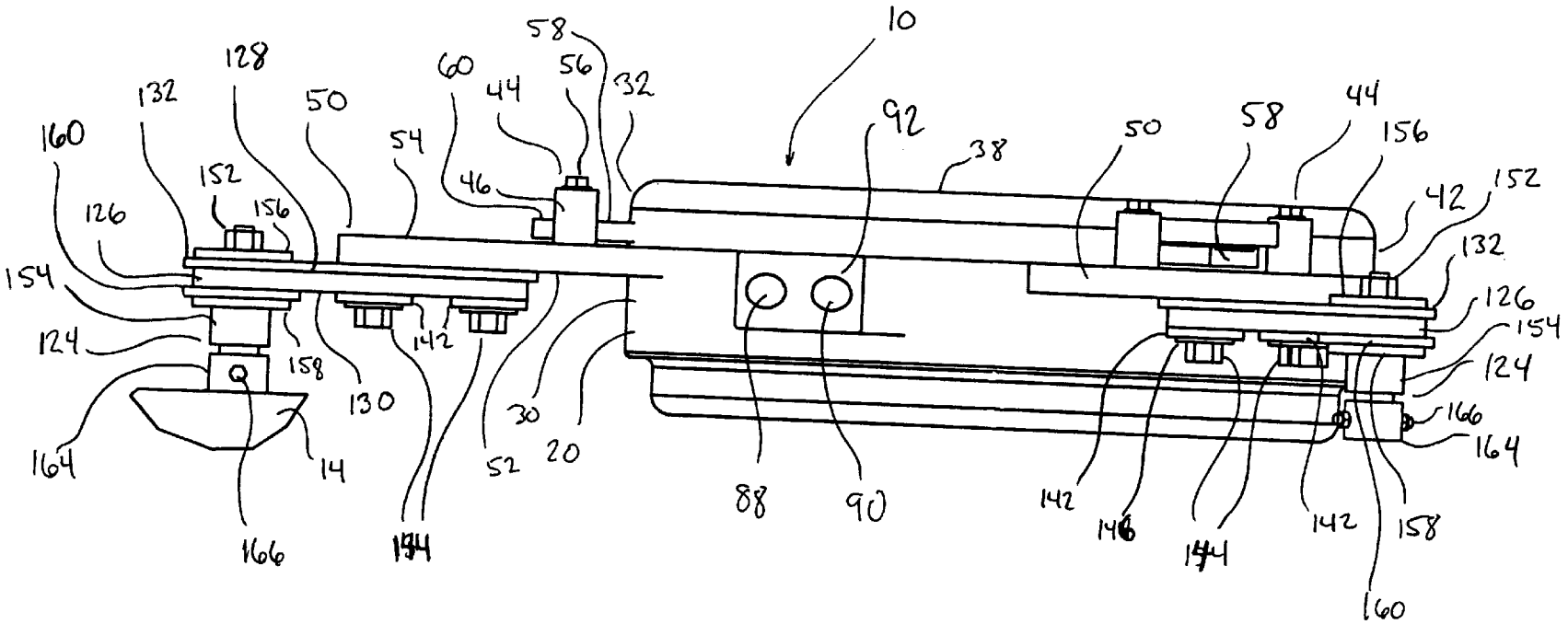
FIG. 3 is a side elevation view of the electrode seal of FIG. 1.

The sealing ring 32 is also provided with three radially outwardly-extending flanges 58 on its outer surface 42. Each flange 58 has an upper surface 60 and a lower surface 62, both of which are perpendicular to the electrode axis. The spacing between adjacent flanges 58 is the same as the spacing between flanges 50 on support ring 20 so that the sealing ring flanges 58 overly the support ring flanges 50 as in FIG. 1.

As shown in FIG. 5, the upper surface 54 of support ring 20 is co-planar with the upper annular sealing surface 26 of support ring 20, and the lower surface 62 of flanges 58 of the sealing ring 32 are axially spaced from the lower annular sealing surface 40 of sealing ring 32, such that the lower surface of each sealing ring flange 58 is spaced from the upper surface 54 of each support ring flange 50. Therefore, the respective flanges 50 and 58 of the support ring 20 and sealing ring 32 do not contact one another during sliding movement of the sealing ring 32.

Preferably, the support ring 20 and the sealing ring 32 are each formed from a thermally conductive metal such as copper alloy.

The electrode seal 10 further comprises retaining means in the form of three hold-down brackets 44, each of which comprises a pair of spaced, vertically-extending hollow cylindrical posts 46 bridged by a solid bar 48 of rectangular cross-section, bar 48 preferably being welded to post 46. One hold-down bracket is attached to the upper surface 54 of a support ring flange 50, being secured 50 by a pair of bolts 56 extending through the hollow interior of the bracket posts 46.

As illustrated in FIG. 5, the horizontal bar 48 of hold-down bracket 44 is spaced axially from the upper surface 54 of flange 50, so as to create a gap 64 having an upper edge 66 which is in close proximity, but spaced from, the upper surface 60 of flange 58.

In the preferred embodiment shown in the drawings, the gap 64 has an axial height of 1⅜ inches, and the upper edge 66 of gap 64 is spaced from the upper surface 60 of flange 58 by about ⅛ inch, thereby preventing substantial axial separation of the sealing ring 32 and the support ring 20, and thereby maintaining the seal between the two rings.

It will be appreciated that the sealing ring flanges 58 extend radially outwardly a sufficient distance such that they are retained in the gaps 64 of brackets 44 regardless of the extent of sliding movement of the sealing ring 32 relative to the support ring 20.

Preferably, the hold-down brackets 44 are spaced from the outer surface 42 of sealing ring 32 by a distance such that the sliding movement of the sealing ring 32 along its lower annular sealing surface 40 is limited in all directions to maintain substantially complete registry between the first and second apertures 22 and 34. In other words, lateral movement of the sealing ring 32 is limited such that no part of the second aperture 34 will be permitted to extend radially outwardly of the edges of the first aperture 22. The sliding movement of the sealing ring 32 is limited by engagement of the outer surface 42 of sealing ring 32 with the axially extending posts 46 of hold-down brackets 44. In the preferred embodiment shown in the drawings, the sliding movement of sealing ring 32 is limited to about 2 inches in any direction.

As illustrated in the drawings, the support ring 20 and sealing ring 32 are provided with circumferential passages 78 and 80, respectively, for cooling water. These passages 78 and 80 are preferably about 1¾ inches in diameter and extend substantially completely through the entire circumference of the support ring 20 and sealing ring 32.

Figure 7:
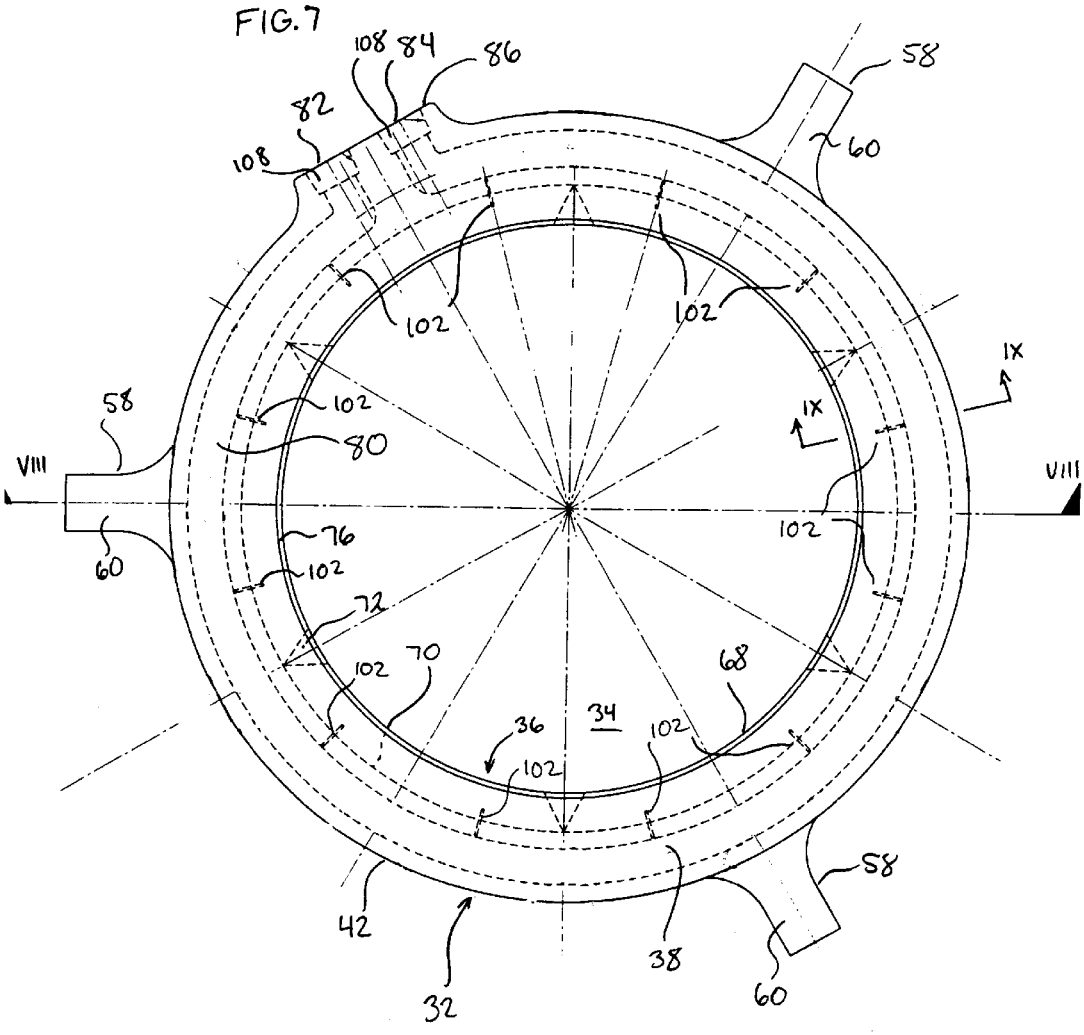
FIG. 7 is an isolated, top plan view of the sealing ring portion of the electrode seal of FIG. 1.

The circular passage 80 of sealing ring 32 is illustrated in FIG. 7, extending throughout substantially the entire circumference of sealing ring 32 between inlet port 82 and outlet port 84, both of which are provided in close proximity to one another on a flat connecting surface 86 provided on the outer surface of sealing ring 32.

Figure 10:
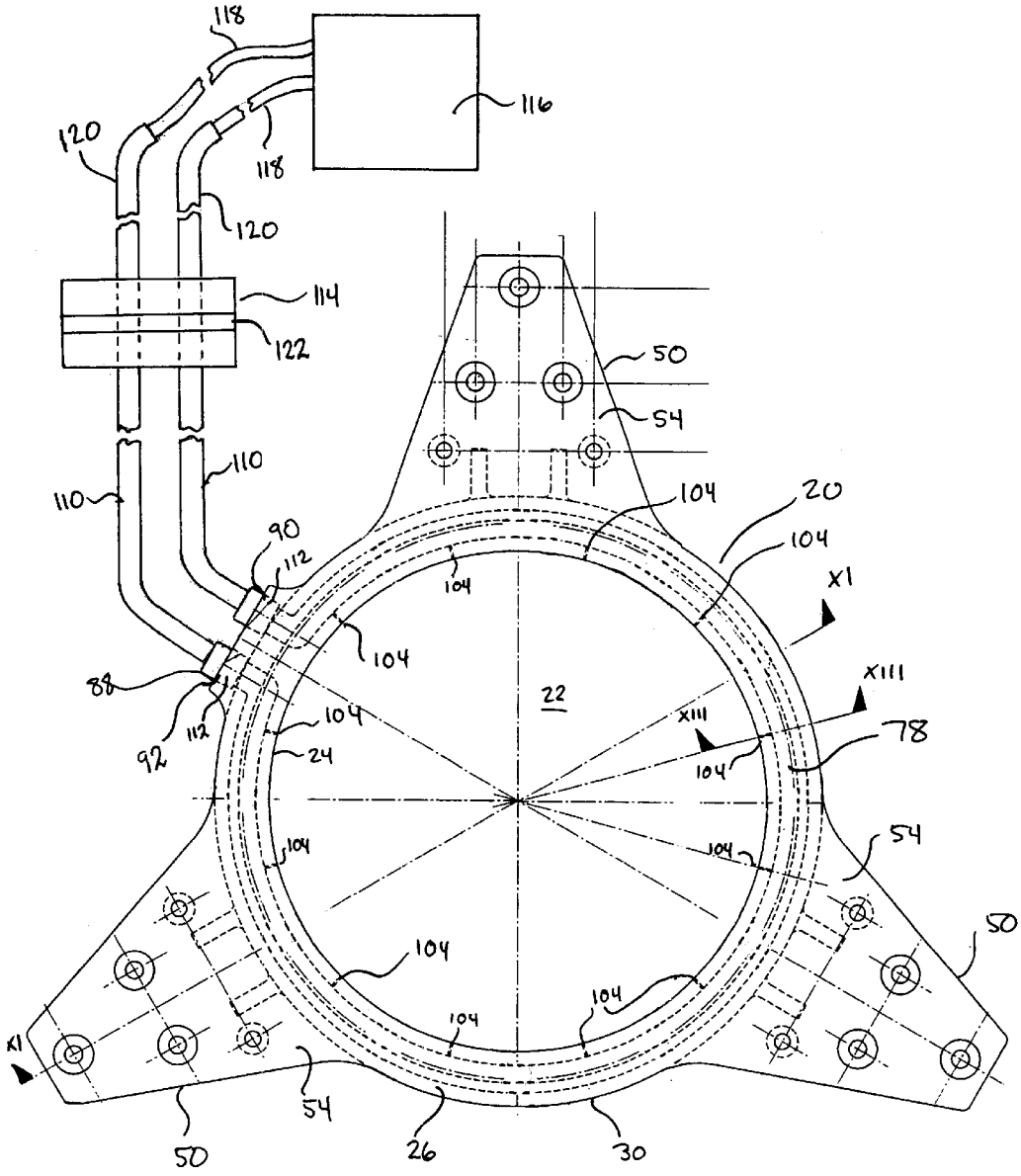
FIG. 10 is an isolated, top plan view of the support ring of the electrode seal shown in FIG. 1.

Similarly, as shown in FIG. 10, the cooling passage 78 of 20 extends around substantially the entire circumference of support ring 20 between an inlet port 88 and an outlet port 90 provided in close proximity to one another on a flat connecting surface 92 located on the outer surface 30 of support ring 20.

Figure 9:
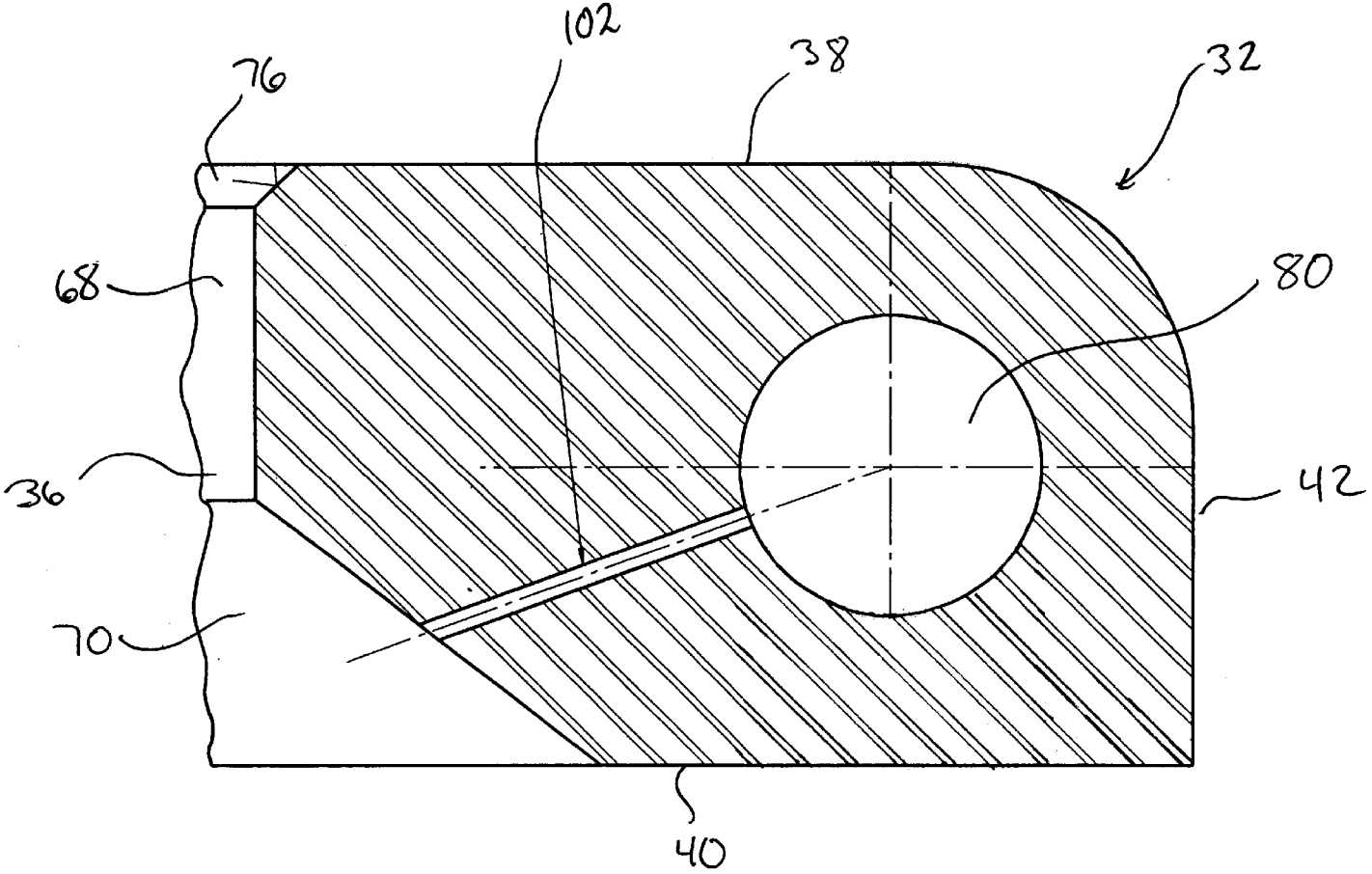
FIG. 9 is a cross-sectional view along line IX—IX of FIG. 7.

As illustrated in FIG. 8, the sealing ring 32 is provided with a plurality of water passages 102 on its inner surface 36. As shown in FIG. 9, these water passages 102 comprise holes extending through the sealing ring 32 from the inner surface 36 to the interior of the cooling passage 80. Thus, some of the cooling water circulating in the cooling passage 80 is ejected through these water passages 102 onto the outer surface of electrode 12, thereby cooling the electrode 12 and somewhat shielding it from the corrosive atmosphere inside the furnace, thereby extending its life. Preferably, the water passages 102 have a diameter of about ⅛ inch and extend inwardly and downwardly from the cooling passage 80 to the lower outwardly extending portion 70 of the inner surface 36 of sealing ring 32, thereby being spaced from the surface of the electrode 12.

Figure 11:
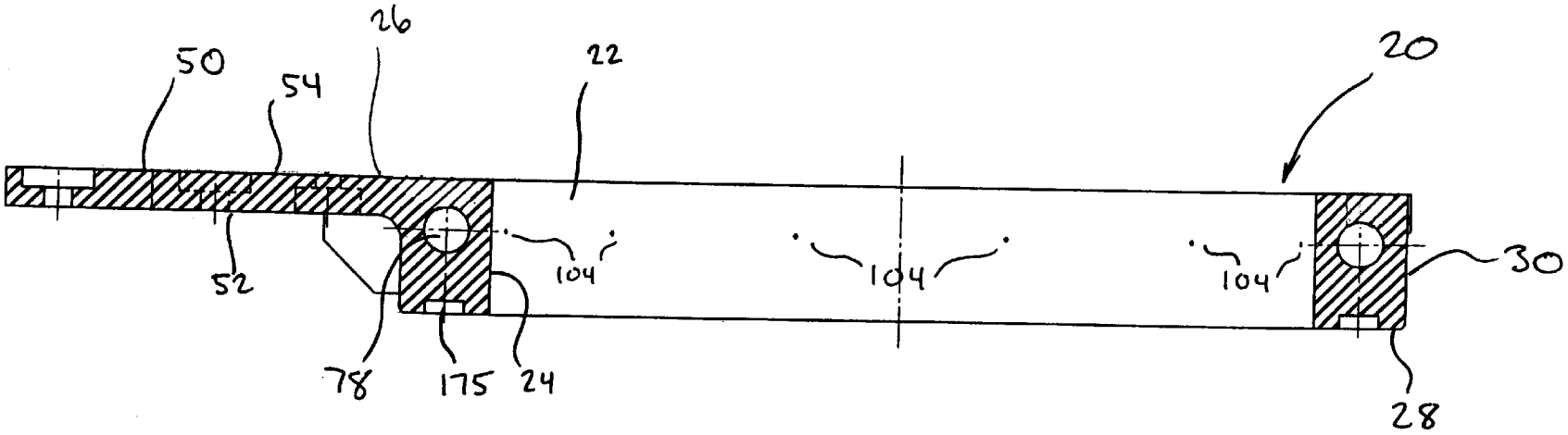
FIG. 11 is a cross-sectional view along line XI—XI of FIG. 10.
Figure 12:
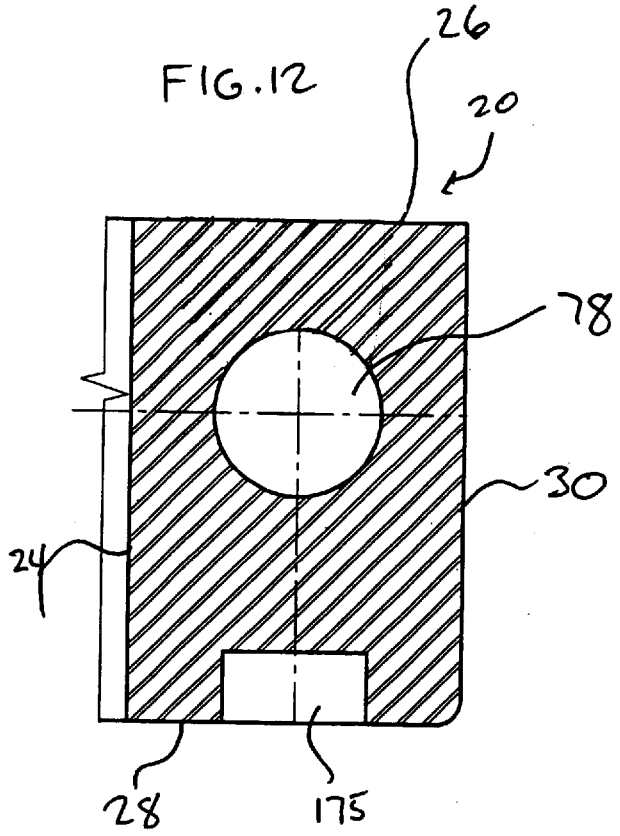
FIG. 12 is an enlargement of the right-hand side of the cross-sectional view of FIG. 11.
Figure 13:
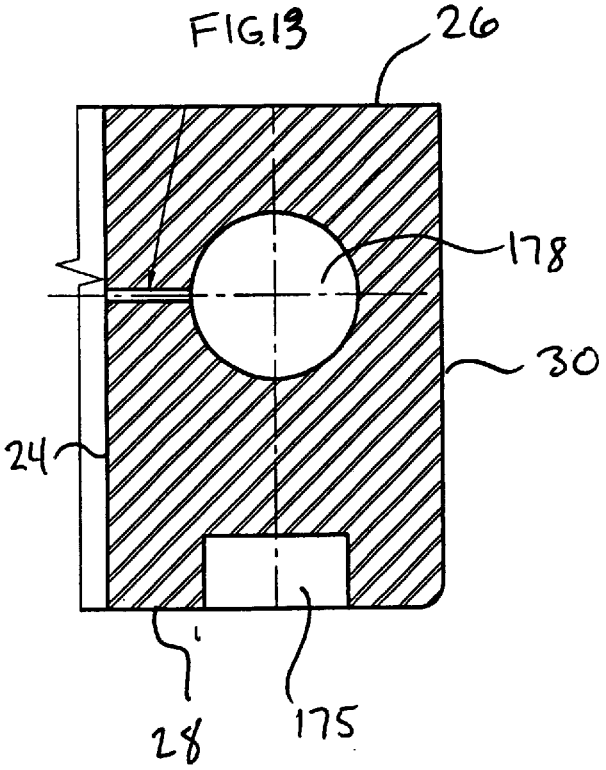
FIG. 13 is a cross-sectional view along line XIII—XIII of FIG. 10.

As shown in FIGS. 11 and 13, the support ring 20 is similarly provided with a plurality of spaced water passages 104, comprising holes extending through the support ring from its inner surface 24 to the interior of cooling passage 78. Cooling passages 104 preferably extend horizontally between the cooling passage 78 and the axially extending inner surface 24, and preferably have a diameter of about ⅛ inch.

The cooling water is continuously recirculated into and out of the support ring 20 and the sealing ring 32 through hoses which are connected to a source of cooling water. For example, FIG. 10 shows a pair of flexible metal hoses 110 connected to threaded counterbores 112 formed in the connecting surface 92 of support ring 20.

Still referring to FIG. 10, the flexible metal hoses 110 are in electrical contact with electrode 12 through the support ring 20 and are therefore "live". These hoses 110 are connected to a steel header (schematically shown as 114) which is connected to a source of cooling water (schematically shown as 116) through a pair of insulating rubber hoses 118, which are preferably protected from damage inside a pair of mild steel pipes 120 over at least a portion of their length. The steel header 114 is located a sufficient distance from electrode 12 such that there will be no arcing between electrode and header 114, and is provided with a layer of insulation 122 which prevents conduction of electricity through the header 114. Although not shown, it will be appreciated that a similar arrangement is provided for connecting the sealing ring 32 to a source of cooling water.

The means for mounting the electrode seal on the roof of a DC arc furnace will now be described below.

As illustrated in FIGS. 1, 2, 4 and 5, the support ring 20 is connected to the refractory portion 14 of the furnace roof by a plurality of mounting feet 124. In the preferred electrode seal 10 shown in the drawings, the support ring 20 is provided with three mounting feet 124, each of which is rigidly secured to the radially outermost end of an extension arm 126, the extension arm 126 being rigidly secured to one of the support ring flanges 50. Extension arms each have a flat upper surface 128 and a flat lower surface 130. The length of the extension arms 126 is such that the mounting feet 124 will be located a sufficient distance from the electrode 12 that arcing will not occur between the electrode 12 and the mounting feet 124. Preferably, the mounting feet 124 are located about 40 inches from the centre of the electrode seal 10 and about 20 inches from the outer surface 30 of support ring 20.

Furthermore, the mounting feet 124 are electrically insulated from the support ring 20. This is preferably accomplished by providing a layer 132 of an electrically insulating material over substantially the entire upper surface 128 of each extension arm 126. Thus, when extension arms 126 are secured to the lower surfaces 52 of the support ring flanges 50 by bolts 134 (FIG. 5) or the like, there will be no flow of electricity between support ring flanges 50 and extension arms 126 through insulating layer 132. To prevent electrical contact between flanges 50 and extension arms 126 through bolts 134, an insulating sleeve 138 surrounds the shank 140 of each bolt 134, and an insulating washer 142 is provided between the lower surface 130 of extension arm and the nut 144 and metal washer 146 connected to the threaded end of shank 140.

In the event of failure in the insulating capability of the connection between support ring flange 50 and extension arm 126, each mounting foot 124 is preferably electrically insulated from the extension arm 126 to which it is attached. As shown in FIG. 5, each mounting arm 124 comprises a threaded stud 148 extending through an aperture 150 in the radially outer end of the extension arm 126. The stud 148 is secured to the upper and lower surfaces 128 and 130 of mounting arm 126 by nuts 152 and 154, respectively, and metal washers 156 and 158, respectively. The upper washer 156 is insulated from the upper surface 128 of extension arm 126 by the insulating layer 132, and the lower washer 158 is separated from the extension arm 126 by insulating washer 160. In addition, an insulating sleeve 162 is provided inside aperture 150 to prevent electrical contact between stud 148 and extension arm 126.

Each mounting foot 124 additionally comprises a metal mounting sleeve 164 at the lower end of threaded stud 148. The mounting sleeve 164 is preferably welded to the steel frame which forms the perimeter of the refractory portion 14, and the studs 148 are secured to the mounting sleeves 164 by pins 166 passing through aligned apertures 168 and 170 in the stud 148 and the mounting sleeve 164, respectively. The electrode seal 10 can be removed from the refractory portion 14 of the furnace roof by removing pins 166 and lifting the seal 10 from the mounting sleeves 164, which remain attached to the refractory portion 14.

As shown in the drawings, particularly FIG. 4, the mounting feet 124 extend axially below the lower annular surface 28 of support ring 20 by a sufficient distance such that, when the mounting feet 124 are secured to the refractory portion 14 of the furnace roof as described above, an axially extending gap 172 is formed between the lower annular surface 28 of support ring 20 and the refractory portion 14. Thus, substantially the entire weight of the electrode seal is carried by the mounting feet 124.

As shown in FIG. 4, the lower annular surface 28 of support ring 20 is provided with an annular groove 175 of rectangular cross section extending about the entire circumference of the support ring 20. The annular groove 175 retains a sealing element 176 which is somewhat resilient and is compressed between the support ring 20 and the refractory portion 14, thereby sealing gap 172 against the escape of gases from the furnace. The sealing element 174 is comprised of a temperature resistant material, for example a high temperature fiberglass rope, about 1½ inches square, rated to about 1,000° F.

Although the invention has been described in connection with certain preferred embodiments, it is not intended to be limited thereto. Rather, the invention includes all embodiments which may fall within the scope of the following claims.

What is claimed is:

1. An electrode seal for closing a clearance between an aperture in a roof of an electric arc furnace and an axially extending electrode passing through the aperture, the electrode seal comprising:

(a) an annular support ring defining a first aperture having an internal diameter greater than an external diameter of said electrode; said support ring having a radially inwardly facing surface, an upper annular sealing surface and a lower annular surface;

(b) an annular sealing ring defining a second aperture having an internal diameter which is approximately the same as a diameter of the electrode and which is less than the diameter of the first aperture, the sealing ring further comprising a radially inwardly facing surface, an upper surface and a lower annular sealing surface, the lower annular sealing surface of the sealing ring engaging the upper annular sealing surface of the support ring such that the second aperture of the sealing ring is in substantially complete registry with the first aperture of the support ring;

(c) sealing ring retaining means attached to the support ring and positioned radially outwardly of the upper annular sealing surface, said retaining means permitting limited sliding movement of the sealing ring along its lower annular sealing surface while maintaining the substantially complete registry between the first and second apertures, wherein the sliding movement of the sealing ring is limited by engagement with the retaining means and the sealing ring; and (d) a plurality of mounting feet attached to the support ring to secure the support ring to the furnace roof.

2. The electrode seal according to claim 1, wherein the radially inwardly facing surface of the sealing ring comprises:

an axially extending sealing portion proximate the upper surface of the sealing ring;

an outwardly extending portion generally tapering downwardly and radially outwardly from the axially extending sealing portion toward the lower annular sealing surface of the sealing ring; and a plurality of axially extending scraper elements circumferentially spaced from one another and extending downwardly from the axially extending sealing portion, the scraper elements each having a pair of sides extending downwardly toward one another.

3. The electrode seal according to claim 2, wherein the scraper elements are coplanar with the axially extending sealing portion.

4. The electrode seal according to claim 2, wherein the scraper elements are wedge shaped, and wherein the pair of sides of each scraper element meet at a point below the axially extending sealing portion.

5. The electrode seal according to claim 1, wherein a circumferential passage for cooling water is provided inside the sealing ring, and wherein the passage for cooling water is in communication with a plurality of spaced apertures extending through the radially inwardly facing surface of the sealing ring.

6. The electrode seal according to claim 5, wherein the radially inwardly facing surface of the sealing ring comprises:

an axially extending sealing portion proximate the upper surface of the sealing ring; and an outwardly extending portion generally tapering downwardly and radially outwardly from the axially extending sealing portion toward the lower annular sealing surface of the sealing ring, said plurality of spaced apertures being located on said radially outwardly extending portion.

7. The electrode seal according to claim 1, wherein a circumferential passage for cooling water is provided inside the support ring, and wherein the passage for cooling water is in communication with a plurality of spaced apertures extending through the radially inwardly facing surface of the support ring.

8. The electrode seal according to claim 1, wherein the sealing ring further comprises at least one radially outwardly extending flange having an upper surface and a lower surface, and wherein the retaining means has an aperture into which the flange extends, the aperture in the retaining means having an upper edge being located in close proximity to the upper surface of the flange so as to prevent substantial axial separation of the sealing ring and the support ring, the flange being of sufficient length so as to be retained in the aperture in the retaining means regardless of the extent of sliding movement of the of the sealing ring relative to the support ring.

9. The electrode seal according to claim 8, wherein the support ring further comprises at least one radially outwardly extending flange having an upper surface and a lower surface and being axially aligned with a flange of the sealing ring.

10. The electrode seal according to claim 9, wherein the sealing ring retaining means are provided on the upper surface of the at least one support ring flange.

11. The electrode seal according to claim 10, wherein the upper surface of the support ring flange is coplanar with the upper annular sealing surface of the support ring, and wherein the lower surface of the sealing ring flange is axially spaced from the lower annular sealing surface of the sealing ring, such that the lower surface of the sealing ring flange is spaced from the upper surface of the support ring flange.

12. The electrode seal according to claim 9, wherein both the sealing ring and the support ring are provided with a plurality of said flanges circumferentially spaced from one another.

13. The electrode seal according to claim 12, wherein both the sealing ring and the support ring are provided with three of said flanges substantially evenly spaced from one another.

14. The electrode seal according to claim 1, wherein the mounting feet are electrically insulated from the support ring, and are located a sufficient distance from the apertures of the sealing and support rings so as to avoid arcing between the electrode and the mounting feet.

15. The electrode seal according to claim 12, wherein each of the mounting feet is mounted to an extension arm which is secured to one of the support ring flanges and is electrically insulated therefrom.

16. The electrode seal according to claim 1, wherein the mounting feet extend axially below the lower annular surface of the support ring by a sufficient distance such that, when the mounting feet are secured to the furnace roof, an axially extending gap is formed between the lower annular surface of the support ring and the furnace roof, and wherein the electrode seal further comprises:

(e) a sealing element secured to the lower annular surface of the support ring to seal the gap between the lower annular surface of the support ring and the furnace roof.

* * * * *